US008376168B2

(12) United States Patent
Fielden

(10) Patent No.: US 8,376,168 B2
(45) Date of Patent: Feb. 19, 2013

(54) COLLAPSIBLE CONTAINER

(75) Inventor: Richard Steve Fielden, Knoxville, TN (US)

(73) Assignee: Container Technologies Industries, LLC, Helenwood, TN (US)

( * ) Notice: Subject to any disclaimer, the term of this patent is extended or adjusted under 35 U.S.C. 154(b) by 666 days.

(21) Appl. No.: 12/577,440

(22) Filed: Oct. 12, 2009

(65) Prior Publication Data

US 2010/0089916 A1 Apr. 15, 2010

Related U.S. Application Data

(60) Provisional application No. 61/104,485, filed on Oct. 10, 2008.

(51) Int. Cl.
*B65D 6/00* (2006.01)

(52) U.S. Cl. ..... 220/4.28; 220/1.5; 220/4.29; 220/4.34; 220/6; 206/386; 206/503; 206/504; 206/508; 206/512; 217/15; 217/47

(58) Field of Classification Search ..... 220/1.5, 220/4.28, 4.29, 4.32, 4.33, 4.34, 6, 7, 684; 206/508, 386, 503, 504, 512; 217/15, 47
See application file for complete search history.

(56) References Cited

U.S. PATENT DOCUMENTS

| | | | | |
|---|---|---|---|---|
| 5,611,449 | A * | 3/1997 | Pedersen | 220/6 |
| 5,862,931 | A * | 1/1999 | Cox et al. | 220/6 |
| 6,161,715 | A * | 12/2000 | Stolzman | 220/1.5 |
| 7,296,704 | B2 | 11/2007 | Ferrini | |
| 2006/0011625 | A1 * | 1/2006 | Arnold | 220/6 |

* cited by examiner

*Primary Examiner* — Anthony Stashick
*Assistant Examiner* — Elizabeth Volz
(74) *Attorney, Agent, or Firm* — Harness, Dickey & Pierce, P.L.C.

(57) ABSTRACT

A container that is convertible between a collapsed configuration and deployed configuration. The container includes a lower base assembly having sides, and an upper base assembly that is removably coupled to the lower base assembly. A plurality of removable supports are removably erected between the lower base assembly and the upper base assembly when the container is in the deployed configuration, and stowed between the lower base assembly and the upper base assembly when the container is in the collapsed configuration. The container may further include a plurality of sidewalls disposed between the supports and the upper and the lower base assemblies. The sidewalls may each be hingedly coupled to a respective side of the base assembly such that the sidewalls are deployable between the collapsed configuration and a deployed configuration.

18 Claims, 13 Drawing Sheets

COLLAPSIBLE CONTAINER

CROSS-REFERENCE TO RELATED APPLICATIONS

This application claims the benefit of U.S. Provisional Application No. 61/104,485, filed on Oct. 10, 2008. The entire disclosure of the above application is incorporated herein by reference.

FIELD

The present disclosure relates to a collapsible container.

BACKGROUND

This section provides background information related to the present disclosure which is not necessarily prior art.

Containers may be used for a variety of purposes including storage and shipping. When the container is empty and not in use, however, the container may take up a significant amount of space in, for example, a warehouse. Moreover, an unused empty container is costly to transport due to the amount of space that it occupies, which may result in multiple trips to transport a plurality of the empty containers. Multiple trips may result in increased fuel costs needed to transport the containers.

SUMMARY

This section provides a general summary of the disclosure, and is not a comprehensive disclosure of its full scope or all of its features.

The present disclosure relates to a container deployable between a collapsed configuration and deployed configuration. The container includes a lower base assembly, and an upper base assembly that is removably coupled to the lower base assembly. A plurality of removable supports are erect between the lower base assembly and the upper base assembly when the container is in the deployed configuration, and stowed between the lower base assembly and the upper base assembly when the container is in the collapsed configuration. The container may further include sidewalls disposed between the supports and the upper and the lower base assemblies. The sidewalls may be hingedly coupled to one of the base assemblies such that the sidewalls are deployable between the collapsed configuration and the deployed configuration.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
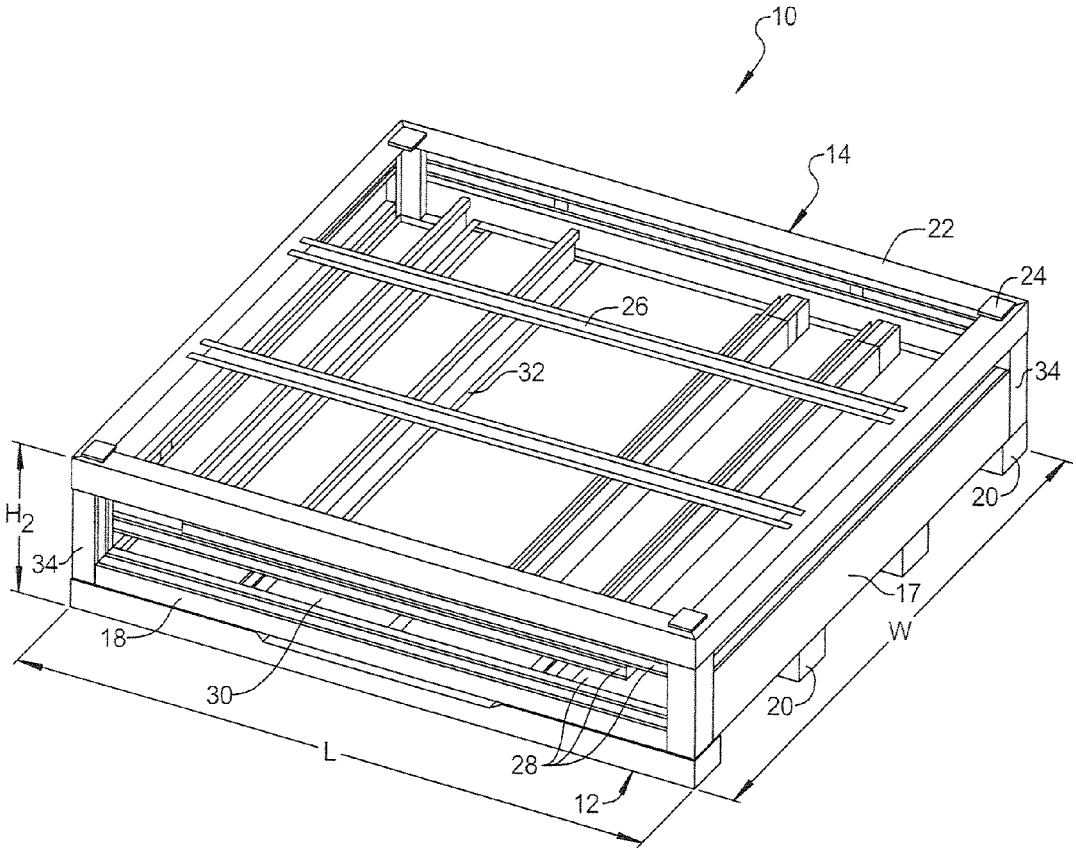
FIG. 1 is a perspective view of a container in a collapsed configuration according to a principle of the present disclosure.

FIGS. 1-6 illustrate a container 10 according to the present disclosure. FIG. 1 illustrates container 10 in a collapsed configuration. FIGS. 2-5 illustrate container 10 in a deployed configuration. Container 10 includes a lower base assembly 12 and an upper base assembly 14. Lower base assembly 12 includes lower frame members 17, 18, 21, and 23 that may be disposed along sides of container 10 that form a width W and a length L of container 10. Width W and length L may each be about 7 feet in length. One skilled in the art, however, will readily acknowledge and appreciate that container 10 may be modified to include any width W and length L desired. Moreover, as will be described later, each of lower frame members 17, 18, 21, and 23 include different heights.

Supporting lower frame members 17, 18, 21, and 23 are a plurality of cross-beams 20. Cross-beams 20 may each be spaced from each other at a distance that is satisfactory to accommodate tines of a fork-lift. In this manner, regardless of whether container 10 is in a deployed or collapsed configuration, container 10 may be easily transported or stacked. Disposed on cross-beams 20 and between lower frame members 17, 18, 21, and 23 is a floor panel 19.

Figure 5:
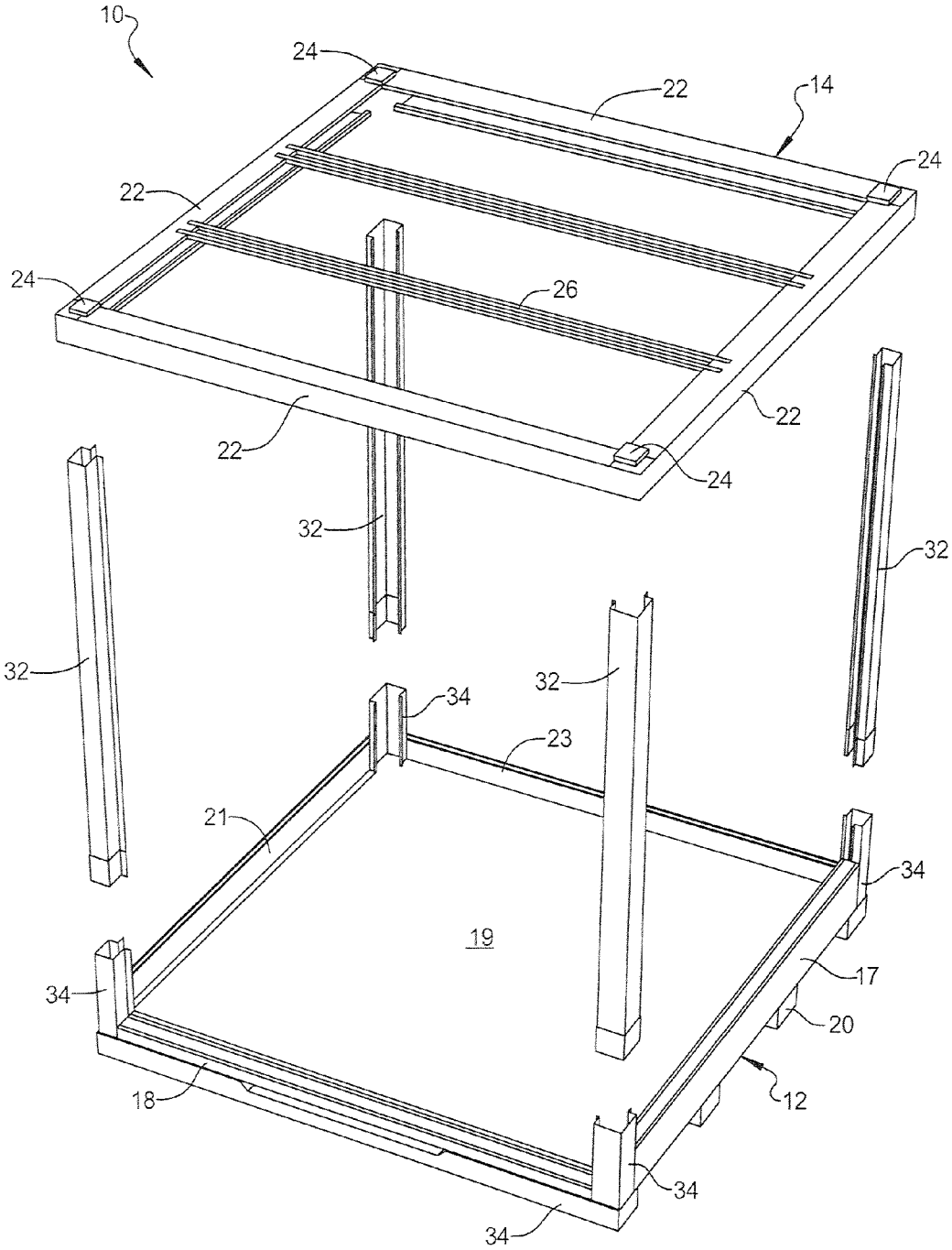
FIG. 5 is an exploded perspective view of a container in a deployed configuration without sidewalls according to a principle of the present disclosure.

As illustrated in FIGS. 1 and 5, upper base assembly 14 includes upper frame members 22. Disposed between one set of opposed upper frame members 22 are one or more trusses 26. Upper frame members 22 and trusses 26 may support a roof panel (not shown). To accommodate another container 10 stored thereon, upper base assembly 14 may include protrusions 24 that are formed at corners between upper frame members 22. Protrusions 24 may be male mounting portions that are adapted to mount or engage with female mounting portions 25 (FIG. 3) that may be formed at corners of lower base assembly 12. Female mounting portions 25 may be formed at corners of the cross-beams 20.

Container 10 also includes primary support members 32. Primary supports 32 may be hollow, square or rectangular tubular members or, as shown in FIG. 1, may be substantially L-shaped. When container 10 is in the collapsed configuration, primary support members 32 are stowed between upper base assembly 14 and lower base assembly 12.

Figure 2:
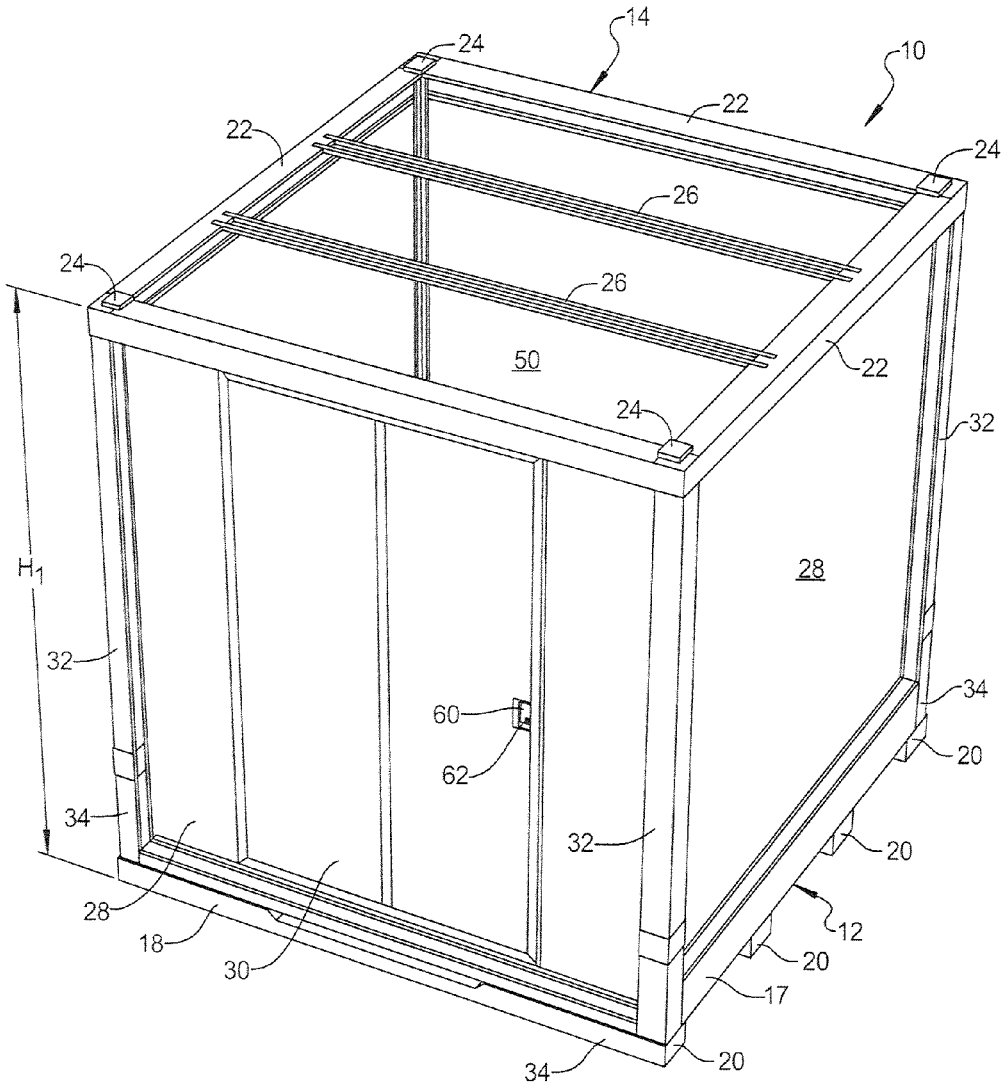
FIG. 2 is a perspective view of a container in a deployed position according to a principle of the present disclosure.
Figure 3:
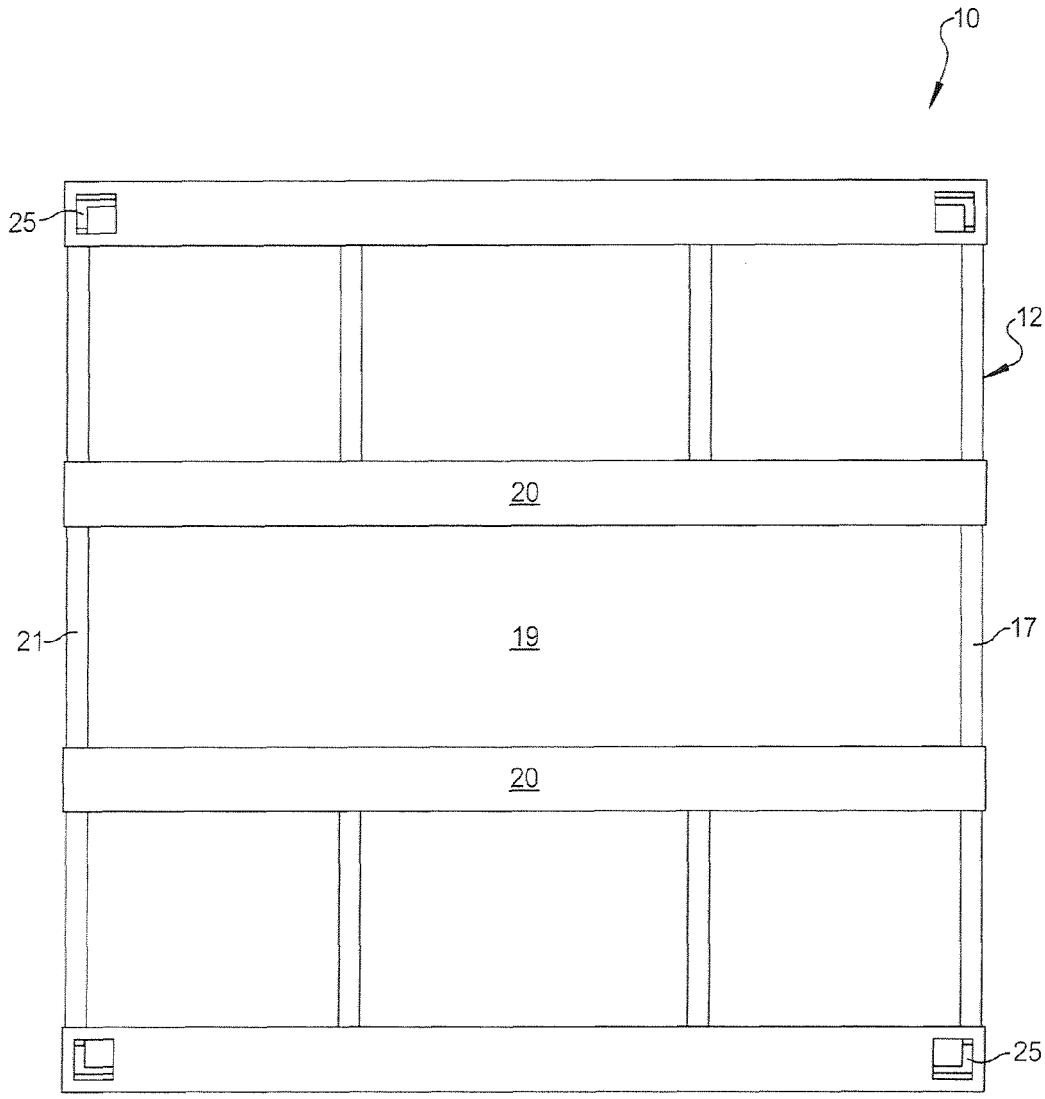
FIG. 3 is a bottom perspective view of a container according to a principle of the present disclosure.

When container 10 is in a deployed configuration, referring to FIG. 2, primary supports 32 mount between and to secondary supports 34 and upper frame members 22. Secondary supports 34 are formed and attached to the lower base assembly 12 at joints located between lower frame members 17, 18, 21, and 23. As shown in FIGS. 1 and 2, secondary supports 34 are formed to have a height less than that of primary supports 32. In this manner, when collapsible container 10 is in the collapsed configuration, container 10 may have a height that is substantially less than that of collapsible container 10 when in its deployed configuration. In particular, container 10 may have a height $H_1$ in a deployed configuration of about 7 feet. In the collapsed configuration, container 10 may have a height $H_2$ of about 16 to 24 inches, with a preferred height $H_2$ of about 19 to 20 inches.

Materials that may be utilized to fabricate upper base assembly 14, lower base assembly 12, primary supports 32, secondary supports 34, and trusses 26 include metal materials such as steel and aluminum, and rigid plastic materials as are known in the art. One skilled in the art will appreciate, however, that additional materials are contemplated and, therefore, the present disclosure should not be limited to the above-noted materials.

Figure 4:
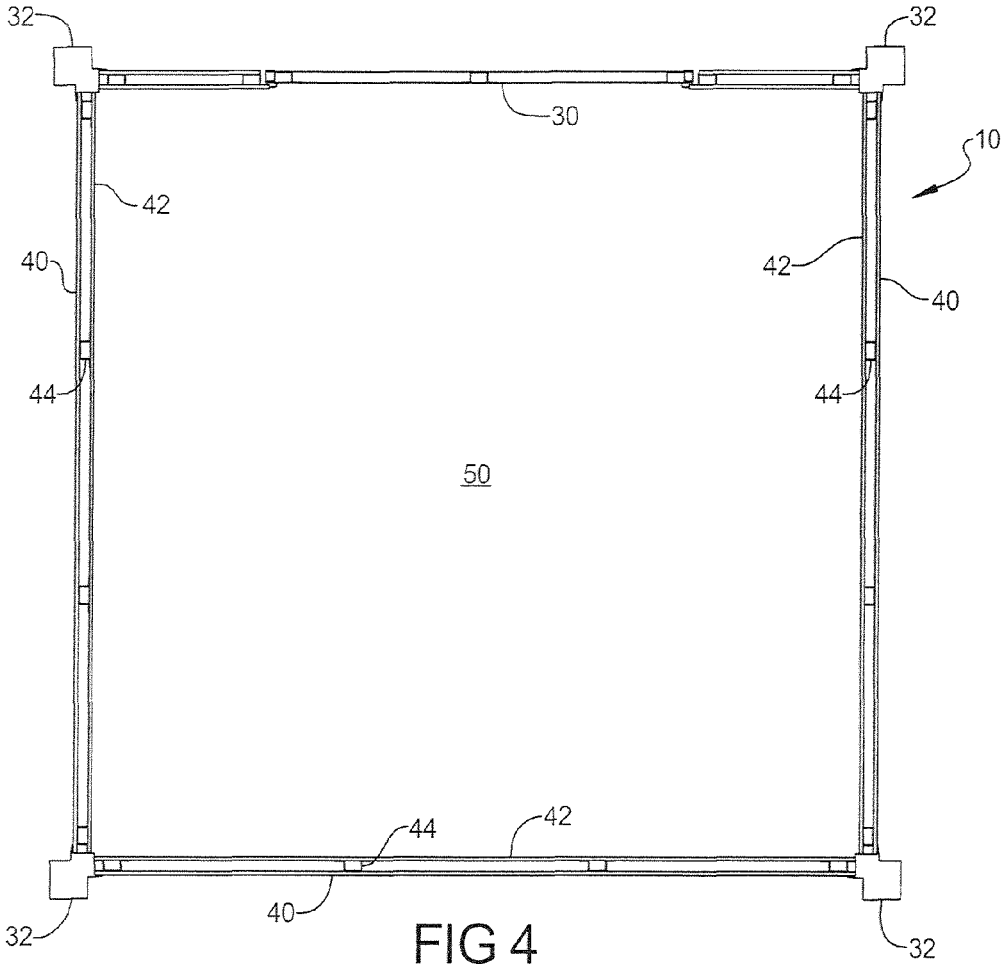
FIG. 4 is a cross-sectional view a container according to the present disclosure.

Now referring to FIGS. 1, 2, 4 and 7-11, container 10 includes a plurality of sidewalls 28. Sidewalls 28 are shown collapsed in FIG. 1, while FIG. 2 illustrates sidewalls 28 in a deployed configuration. FIG. 4 illustrates sidewalls 28 that may include an outer panel 40 and an inner panel 42, with a plurality of support brackets 44 therebetween to provide strength and rigidity to sidewalls 28. Panels 40 and 42 of sidewalls 28 may be formed of materials such as plywood, plastic-coated plywood, corrugated aluminum, corrugated plastic, or any other material that may be desired depending on the use of container 10. To provide access to an interior 50 of container 10, a doorway 30 may be formed in one of sidewalls 28. Doorway 30 may be provided with a handle 60 that may include locking mechanism 62 to secure contents stowed within container 10.

To deploy container 10 from a collapsed configuration to a deployed configuration, upper base assembly 14 may be removed from lower base assembly 12. Primary supports 32 may be then removed from storage on lower base assembly 12 and mated with secondary supports 34. Once primary supports 32 are mated with secondary supports 34, upper base assembly 14 may be mounted atop the free ends of primary supports 32.

Figure 6:
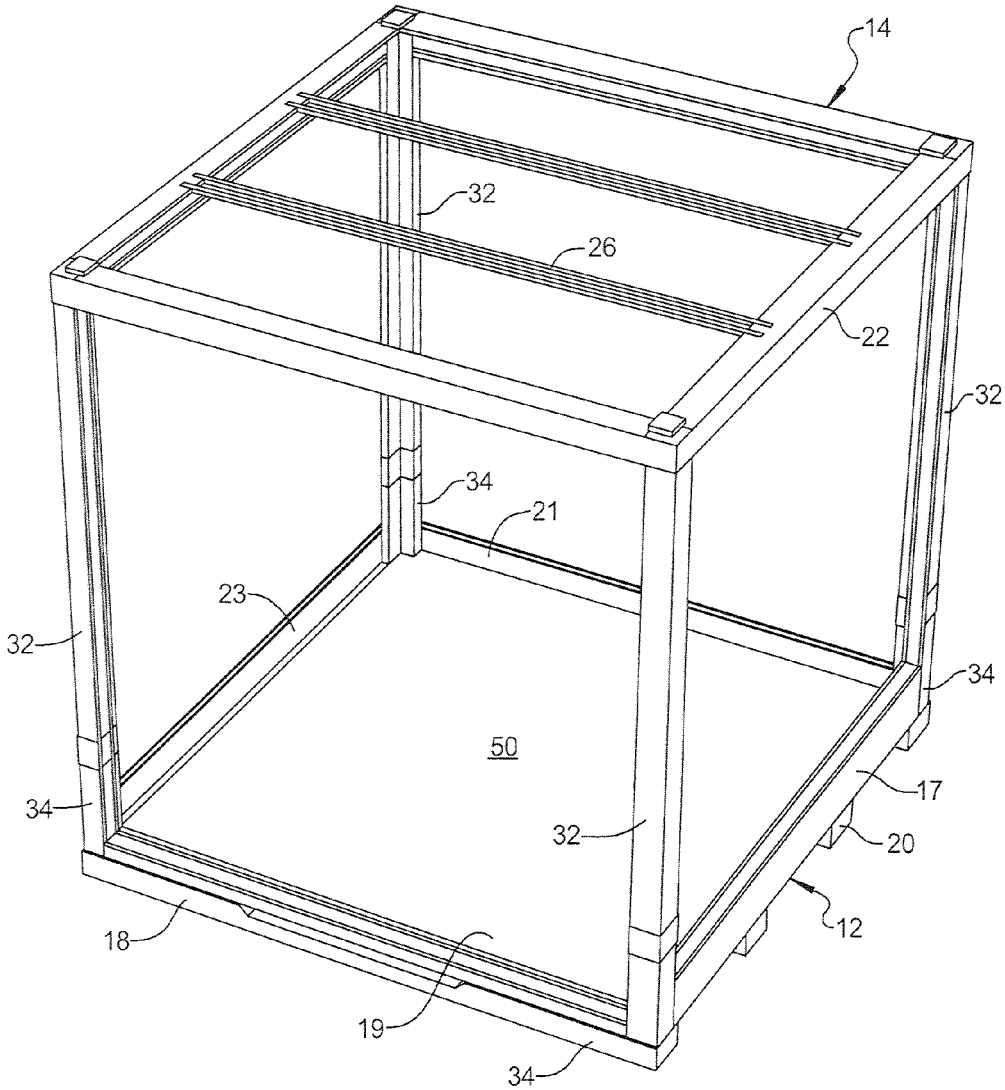
FIG. 6 is a perspective view of a container in a deployed configuration without sidewalls according to a principle of the present disclosure.
Figure 7:
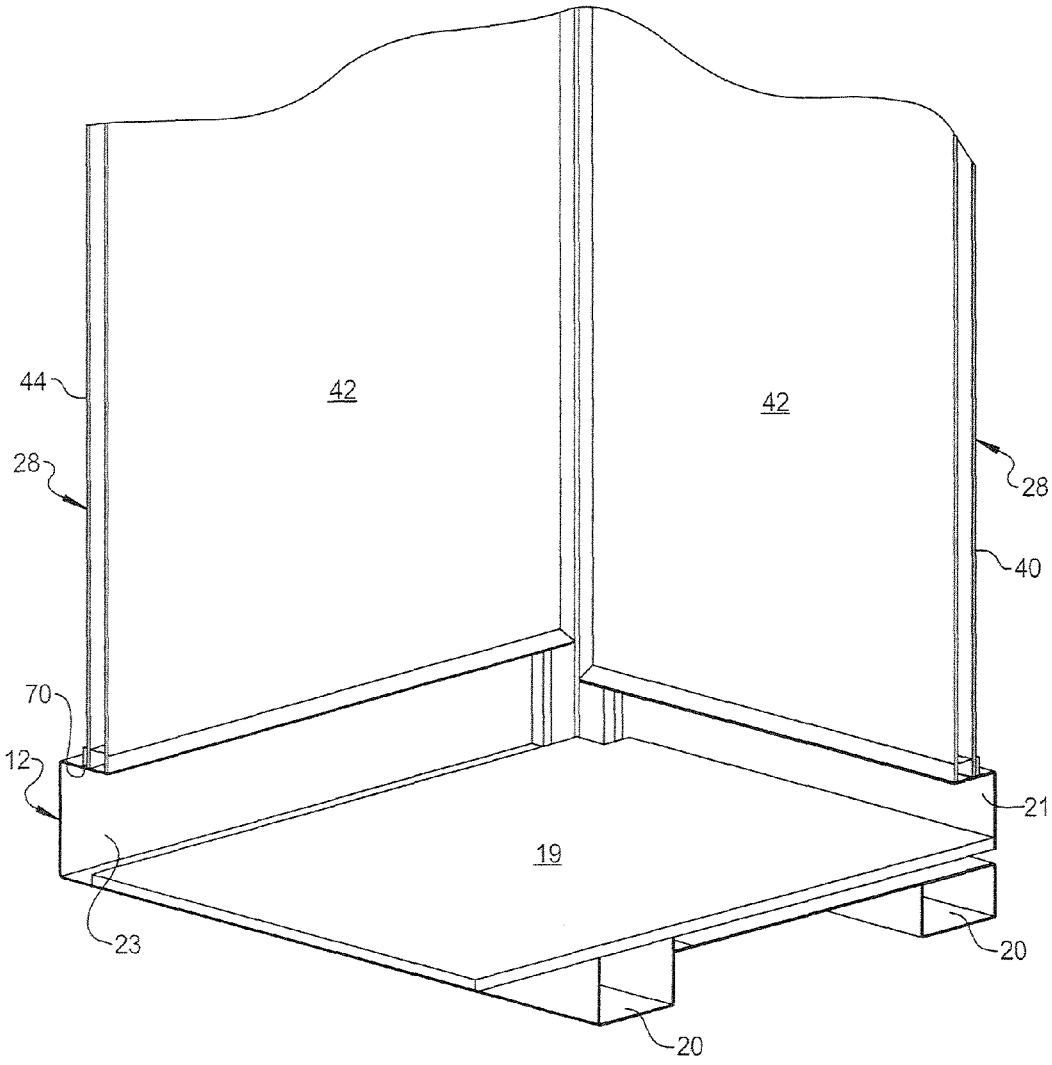
FIG. 7 is a perspective cross-sectional view of a joint between a pair of sidewalls and the floor of a container according to a principle of the present disclosure.

After primary supports 32 are mounted to secondary supports 34, sidewalls 28 may be deployed. Sidewalls 28 may be deployed either prior to or after upper base assembly 14 is mounted atop secondary supports 34. To deploy sidewalls 28, referring to FIGS. 6-9, sidewalls 28 may be pivotably connected to respective sides of lower base assembly 12 by hinges 70. In particular, sidewalls 28 may be hingedly connected to each of lower frame members 17, 18, 21, and 23. As best shown in FIG. 6, lower frame members 17 and 18 are formed to have different heights. Although not shown, lower frame members 21 and 23 are also formed to have different heights relative to each other, as well as to lower frame members 17 and 18. Accordingly, sidewalls 28 hingedly connected to each of lower frame members 17, 18, 21, and 23 each have a different height. Lower frame members 17, 18, 21, and 23 each having a different height enables sidewalls 28 hingedly connected thereto to collapse inward without interfering with one another (FIG. 1).

Figure 8:
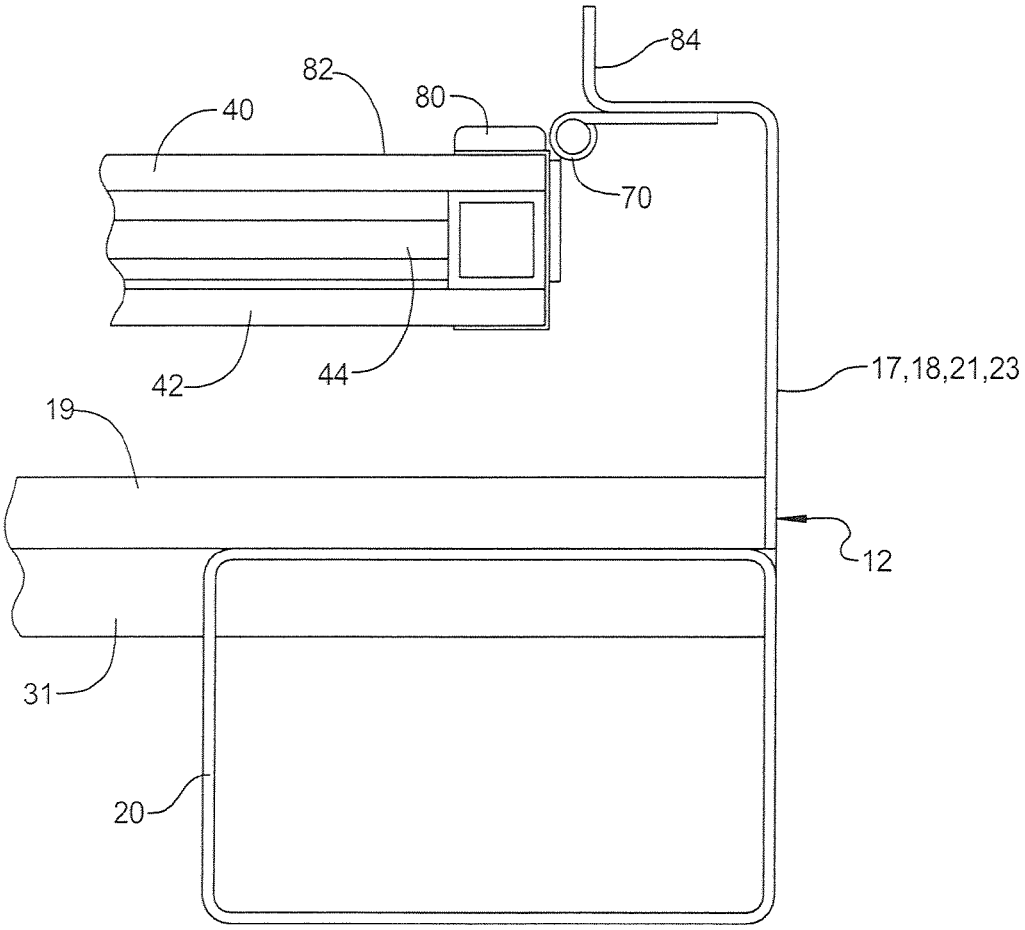
FIG. 8 is a cross-sectional view of a sidewall and hinge of a collapsed container according to a principle of the present disclosure.
Figure 9:
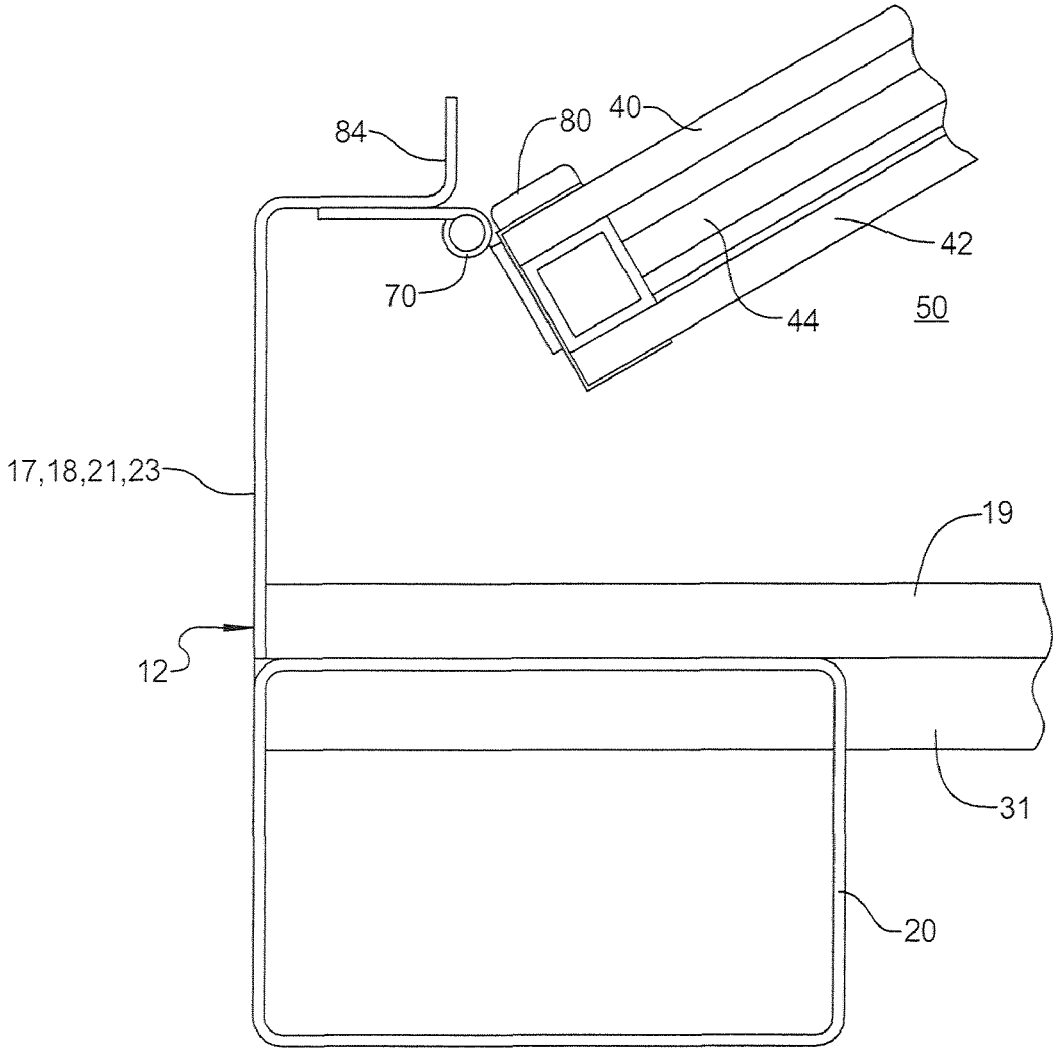
FIG. 9 is a cross-sectional view of the sidewall and hinge of a container as the sidewall begins to move from the collapsed configuration to the deployed configuration according to a principle of the present disclosure.
Figure 10:
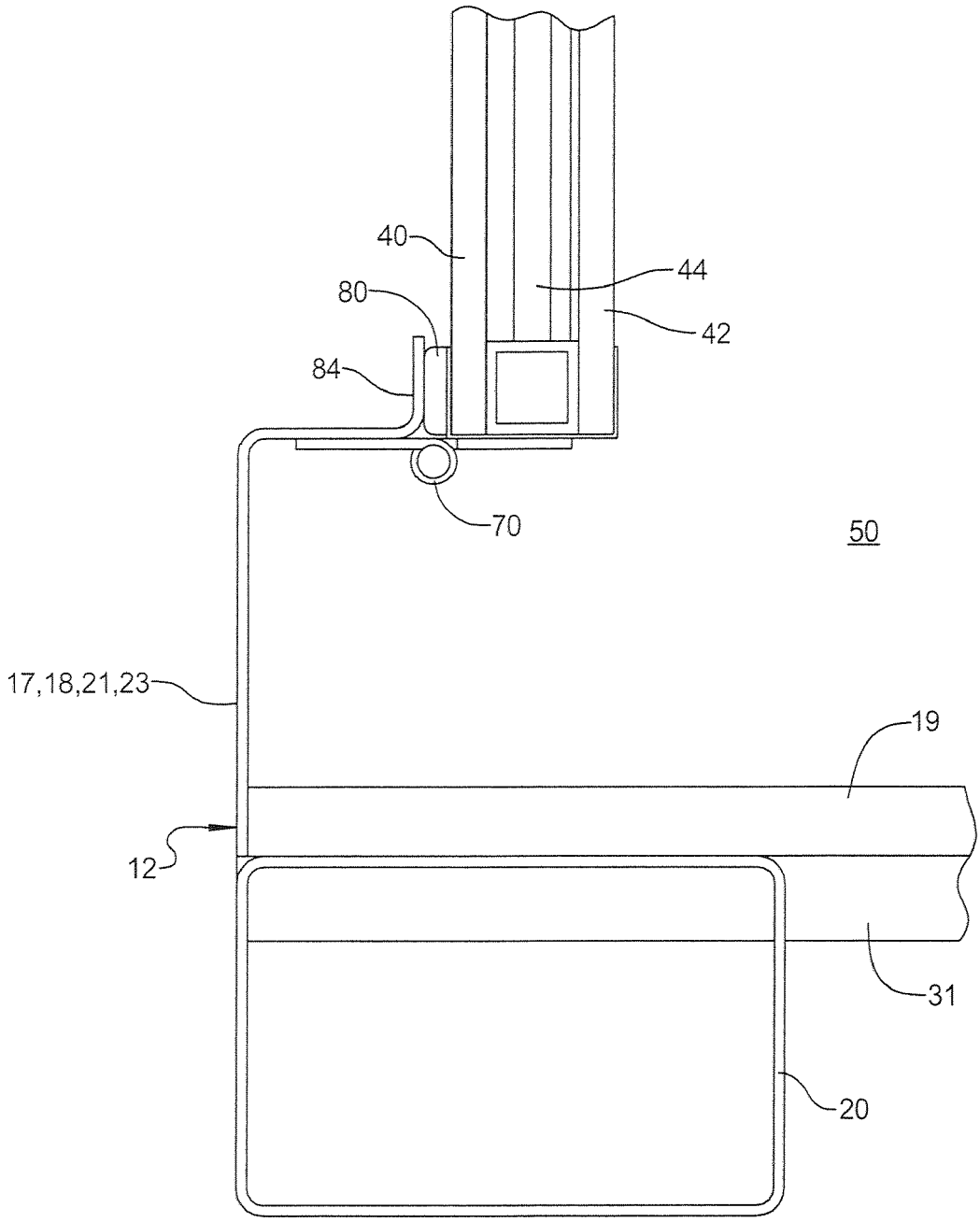
FIG. 10 is a cross-sectional view of the sidewall and hinge of in a fully deployed configuration, according to a principle of the present disclosure.

As best shown in FIGS. 8-10, outer panel 40 of sidewalls 28 may include a static seal 80 at a lower portion 82 thereof. As sidewalls 28 are lifted (FIGS. 9-10), static seals 80 abut flanges 84 that axially extend from each of lower frame members 17, 18, 21, and 23. When static seals 80 abut axially extending flanges 84, container 10 is made weather- and water-resistant. This enables container 10 to be used in a variety of manners including transporting goods at sea, storing goods outdoors, and the like. Although not illustrated in the Figures, it should be understood that static seal 80 may extend around an entire perimeter of outer panel 40 of sidewall 28 to engage surfaces of axially extending flange 84, primary supports 32, secondary supports 34, and upper frame assembly 14 to provide container 10 with a weather- and water-resistant seal around the entire container 10. In addition, as also shown in FIGS. 8-10, lower base assembly 12 further includes a floor support member 31 to which cross-beams 20 and lower frame members 17, 18, 21, and 23 are secured.

To maintain sidewalls 28 in a deployed configuration, hinges 70 may be a spring-loaded or locking type of hinge. Alternatively, upper base assembly 14 may include a groove (not shown) sized to accommodate an upper surface or edge of sidewall 28 that maintains sidewall 28 therein in the deployed configuration when upper base assembly 14 is placed in position atop the deployed container 10. In larger configurations of container 10, sidewalls 28 may be actuated to the deployed configuration using a mechanical device (not shown) such as an electric motor, hydraulic device, or any other mechanical device known to one skilled in the art.

Figure 11:
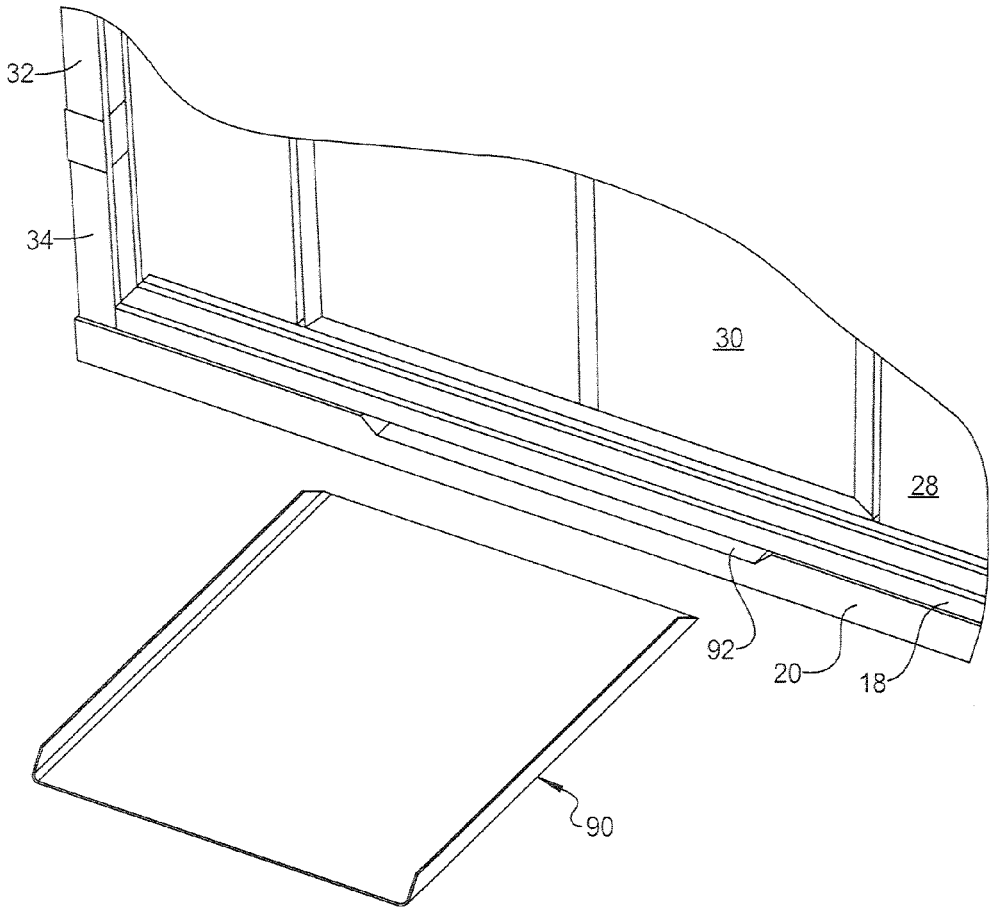
FIG. 11 is a perspective view of a ramp assembly that may be used in conjunction with a collapsible container, according to a principle of the present disclosure.

Referring to FIG. 11, container 10 may include a ramp assembly 90. To accommodate ramp assembly 90, cross-beams 20 formed below doorway 30 may be formed to have a recessed portion 92 that is adapted to accommodate ramp assembly 90. Recessed portion 92 may be formed between cross-beam 20 and lower frame member 18. Moreover, ramp assembly 90 may be shaped to mate with the recess 92 formed in cross-beam 20, Ramp assembly 90 enables a user or operator to more easily wheel merchandise or other material to be stowed within container 10.

Figure 12:
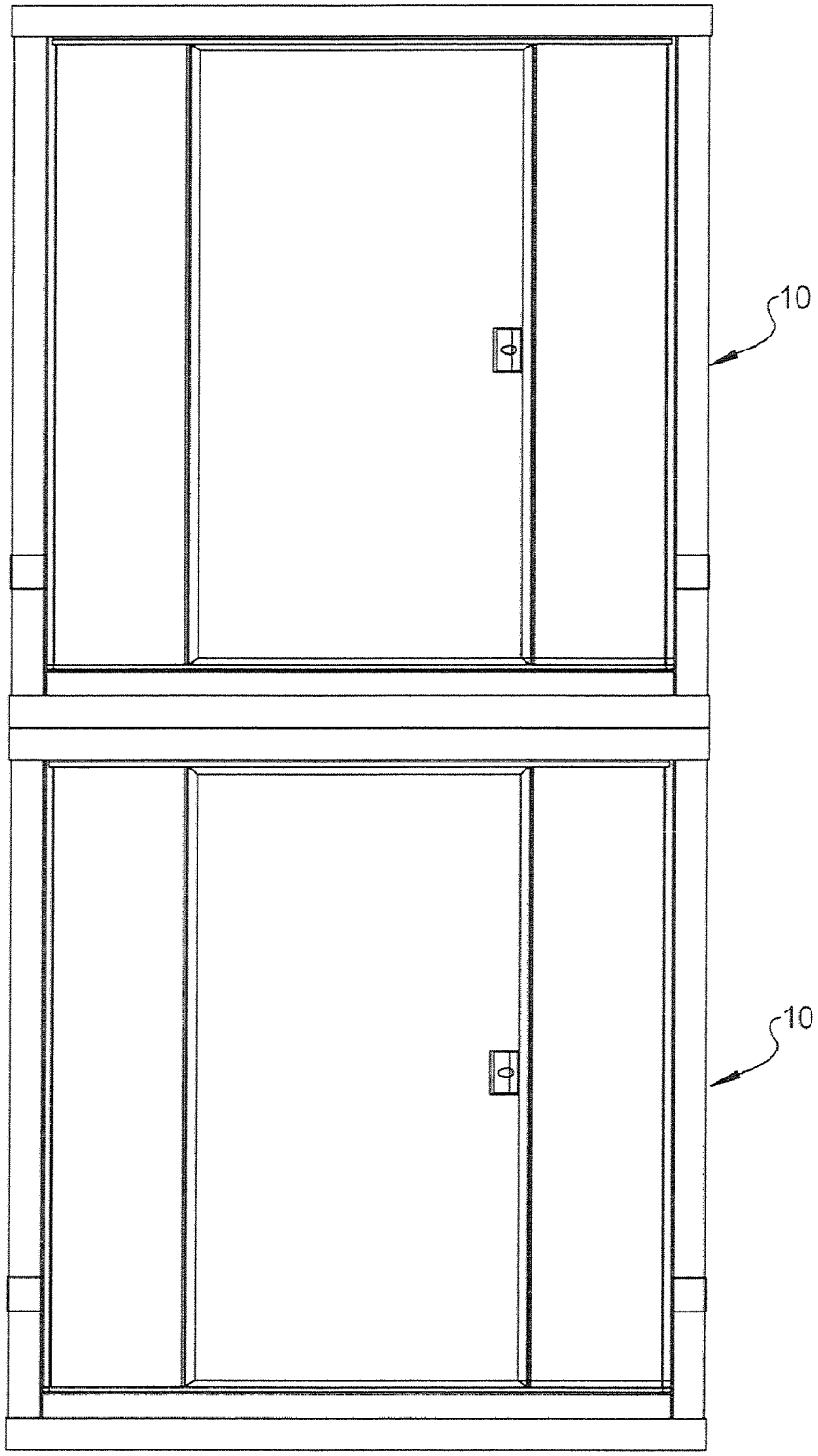
FIG. 12 is a front perspective view of a pair of stacked containers in a deployed configuration, according to a principle of the present disclosure.
Figure 13:
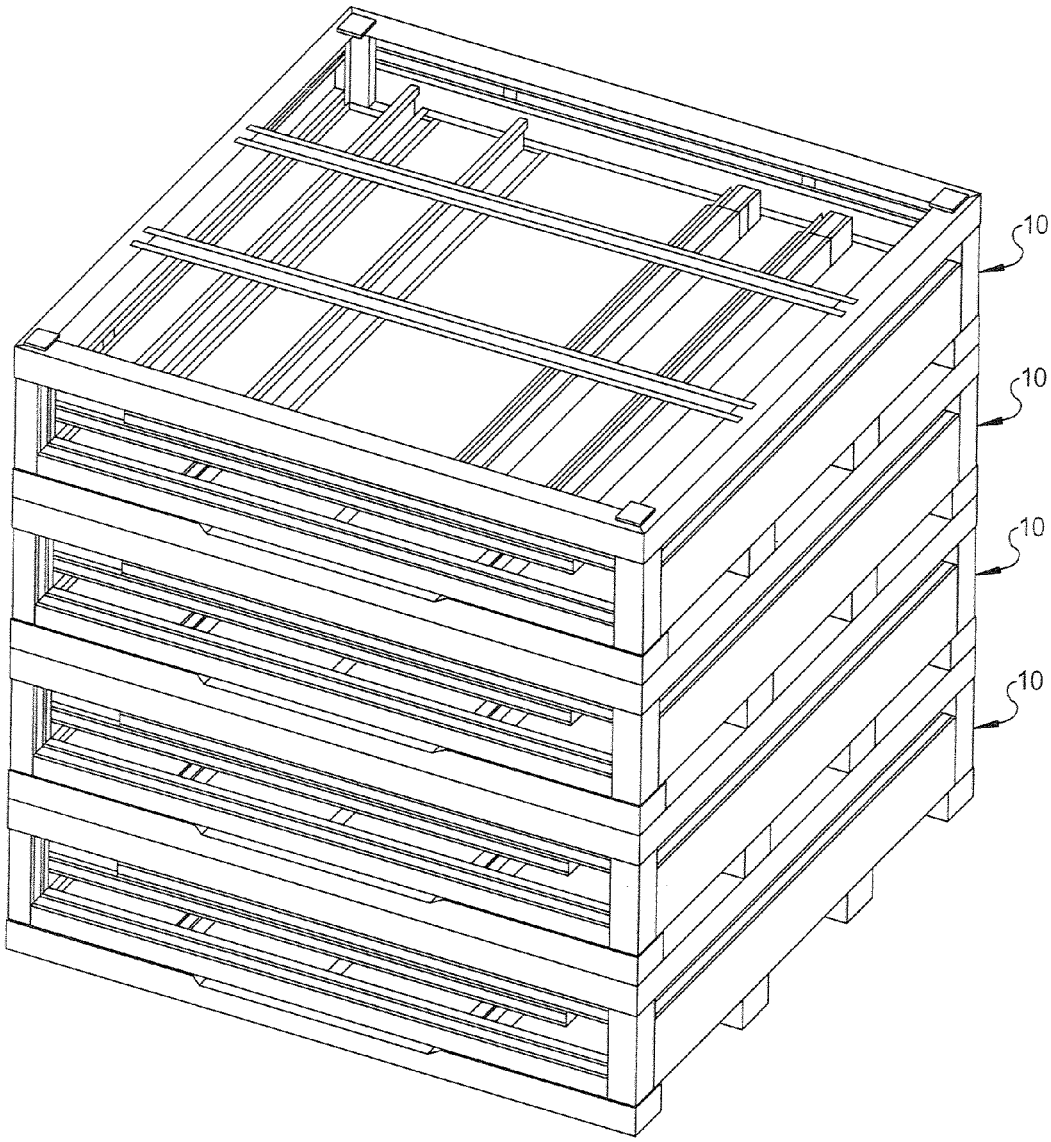
FIG. 13 is a perspective view of a plurality of stacked containers in a collapsed configuration, according to a principle of the present disclosure.

FIGS. 12 and 13 illustrate collapsible containers 10 in a stacked orientation in deployed configurations and collapsed configurations, respectively. Specifically, referring to FIG. 12, it may be seen that at least two (and as many as three) collapsible containers 10 in their deployed configuration may be stacked. In contrast, when collapsible container 10 is in a collapsed configuration, up to four collapsible containers may be stacked (FIG. 13). By stacking collapsible containers 10 in their collapsed configuration in this manner, better use of storage space within a warehouse may be utilized. In addition, transportation of the collapsible containers 10 when they are not in use becomes more efficient, which reduces fuel costs and storage costs, respectively.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A container that is convertible between a collapsed configuration and a deployed configuration, comprising:

a lower base assembly;

a plurality of removable supports operable to be coupled to corners of said lower base assembly;

an upper base assembly operable to be coupled to said corners of said lower base assembly when the container is in the collapsed configuration, and operable to be coupled to said removable supports when the container is in the deployed configuration;

and a sidewall hingedly coupled to each side of said lower base assembly, each sidewall being directed toward an interior of the container when the container is in the collapsed configuration, and erected between said lower base assembly and said upper base assembly when the container is in the deployed configuration, wherein each sidewall includes an inner panel and an outer panel with a plurality of support brackets disposed therebetween.

2. The container of claim 1, wherein said plurality of removable supports are stowable between said lower base assembly and said upper base assembly in the collapsed configuration.

3. The container of claim 1, wherein said upper base assembly includes a plurality of protrusions, said lower base assembly includes a plurality of recesses, and said plurality of protrusions are matable with said plurality of recesses such that another container may be stacked on the container when the container is in either the collapsed or deployed configuration.

4. The container of claim 1, wherein at least one of said sidewalls includes a door that provides access to said interior when the container is in the deployed configuration.

5. The container of claim 1, wherein said lower base assembly, said upper base assembly, and said removable supports are formed from a material selected from the group consisting of steel, aluminum, and rigid plastic.

6. The container of claim 1, wherein each sidewall is formed from a material selected from the group consisting of plywood, plastic-coated plywood, corrugated aluminum, and corrugated plastic.

7. The container of claim 1, wherein each sidewall is hingedly coupled to said lower base assembly by a spring-loaded hinge or a locking hinge that are operable to support said sidewalls when said sidewalls are erected in the deployed configuration.

8. The container of claim 1, wherein each sidewall includes a static seal that seals the container when said sidewalls are erected in the deployed configuration.

9. The container of claim 1, wherein said lower base assembly includes a plurality of secondary supports located at said corners, and said upper base assembly is mountable to said secondary supports when the container is in the collapsed configuration.

10. The container of claim 9, wherein said removable supports are operable to be coupled to said secondary supports when the container is in the deployed configuration.

11. A container system comprising:

a first container that is convertible between a collapsed configuration and deployed configuration; and a second container that is convertible said collapsed configuration and said deployed configuration, said first and second containers each including:

a lower base assembly including an upper surface and a lower surface;

a plurality of removable supports operable to be coupled to said upper surface of said lower base assembly;

an upper base assembly including an upper surface and a lower surface, said lower surface of said upper base assembly operable to be coupled to said upper surface of said lower base assembly when the container is in said collapsed configuration, and said lower surface of said upper base assembly operable to be coupled to said removable supports when the container is in said deployed configuration;

a sidewall hingedly coupled to each side of said lower base assembly, each sidewall being directed toward an interior of the container when the container is in said collapsed configuration, and erected between said lower base assembly and said upper base assembly when the container is in said deployed configuration; wherein each sidewall includes an inner panel and an outer panel with a plurality of support brackets disposed therebetween;

a plurality of recesses formed in said lower surface of said lower base assembly; and a plurality of protrusions formed on said upper surface of said upper base assembly, wherein when said first container is stacked on said second container in either said collapsed or said deployed configuration, said protrusions of said first container mate with said recesses of said second container.

12. The container system of claim 11, wherein said lower base assembly, said upper base assembly, and said removable supports are formed from a material selected from the group consisting of steel, aluminum, and rigid plastic.

13. The container system of claim 11, wherein said inner panel and said outer panel are each formed from a material selected from the group consisting of plywood, plastic-coated plywood, corrugated aluminum, and corrugated plastic.

14. The container system of claim 11, wherein said lower base assembly includes a plurality of secondary supports located at said upper surface, and said upper base assembly is mountable to said secondary supports when the container is in said collapsed configuration.

15. The container system of claim 14, wherein said removable supports are operable to be coupled to said secondary supports when the container is in said deployed configuration.

16. The container system of claim 11, wherein said plurality of removable supports are stowable between said lower base assembly and said upper base assembly in said collapsed configuration.

17. The container system of claim 16, wherein each sidewall includes a static seal that seals the container when said sidewalls are erected in said deployed configuration.

18. The container system of claim 16, wherein at least one of said sidewalls includes a door that provides access to said interior when the container is in the deployed configuration.

* * * * *